US011598562B2

(12) United States Patent
Guo

(10) Patent No.: US 11,598,562 B2
(45) Date of Patent: Mar. 7, 2023

(54) COMPRESSOR WITH OIL EQUALIZING PIPE, PARALLEL COMPRESSOR SET, AND OIL EQUALIZING METHOD

(71) Applicant: SUZHOU INVOTECH SCROLL TECHNOLOGIES CO., LTD., Jiangsu (CN)

(72) Inventor: Huaming Guo, Jiangsu (CN)

(73) Assignee: SUZHOU INVOTECH SCROLL TECHNOLOGIES CO., LTD., Jiangsu (CN)

( * ) Notice: Subject to any disclaimer, the term of this patent is extended or adjusted under 35 U.S.C. 154(b) by 255 days.

(21) Appl. No.: 16/652,345

(22) PCT Filed: Jun. 27, 2018

(86) PCT No.: PCT/CN2018/093204
§ 371 (c)(1),
(2) Date: Mar. 30, 2020

(87) PCT Pub. No.: WO2019/091126
PCT Pub. Date: May 16, 2019

(65) Prior Publication Data

US 2020/0232687 A1 Jul. 23, 2020

(30) Foreign Application Priority Data

Nov. 7, 2017 (CN) ..... 201711087801.6

(51) Int. Cl.
*F25B 31/00* (2006.01)
*F25B 49/02* (2006.01)
(Continued)

(52) U.S. Cl.
CPC ..... *F25B 31/004* (2013.01); *F04B 39/0207* (2013.01); *F04B 53/18* (2013.01);
(Continued)

(58) Field of Classification Search
CPC .... F04B 39/0207; F04B 53/18; F04C 29/021; F25B 31/004; F25B 49/022;
(Continued)

(56) References Cited

U.S. PATENT DOCUMENTS 3,392,916 A * 7/1968 Engstrom ..... B05B 17/0623 366/101
4,383,802 A * 5/1983 Gianni ..... F04C 23/001 62/193
(Continued)

FOREIGN PATENT DOCUMENTS

CN 1548767 A 11/2004
CN 201196145 Y 2/2009
(Continued)

OTHER PUBLICATIONS

International Search Report of PCT/CN2018/093204, dated Sep. 30, 2018, 8 pages.

*Primary Examiner* — Connor J Tremarche
(74) *Attorney, Agent, or Firm* — Muncy, Geissler, Olds & Lowe, P.C.

(57) ABSTRACT

The present disclosure provides a compressor with an oil equalizing pipe, a parallel compressor set, and an oil equalizing method. The compressor includes at least one oil equalizing pipe, an opening at one end of the oil equalizing pipe is formed in a target oil level of an oil sump, and the opening at the other end of the oil equalizing pipe is formed in a suction port; and when the oil level of the oil sump of the compressor is higher than the target oil level, the extra oil enters the suction port through the oil equalizing pipe. Compared with the prior art, the present disclosure has the advantages that, when the compressor is running, the gas in the suction port flows, so that the pressure at the suction port is less than the pressure on the surface of the oil sump; when the oil level of the oil sump of the compressor is higher than
(Continued)

the target oil level, the extra oil enters the suction port through the oil equalizing pipe under the action of the above pressure difference, a part of the oil enters vortex and is discharged from the compressor via the exhaust port, and the oil discharged from the compressor returns to the other compressor lack of oil through a pipeline, thereby achieving oil balance between different compressors.

10 Claims, 6 Drawing Sheets

(51) Int. Cl.
*F04B 53/18* (2006.01)
*F04B 39/02* (2006.01)
*F04C 29/02* (2006.01)

(52) U.S. Cl.
CPC ..... *F25B 49/022* (2013.01); *F04C 29/021* (2013.01); *F25B 2400/075* (2013.01); *F25B 2500/16* (2013.01); *F25B 2600/2515* (2013.01); *F25B 2700/03* (2013.01); *F25B 2700/1933* (2013.01)

(58) Field of Classification Search
CPC ..... F25B 2400/075; F25B 2500/16; F25B 2600/2515; F25B 2700/03; F25B 2700/1933
See application file for complete search history.

(56) References Cited

U.S. PATENT DOCUMENTS

| | | | | |
|---|---|---|---|---|
| 5,236,311 | A * | 8/1993 | Lindstrom | F25B 31/002 417/254 |
| 6,941,767 | B2 * | 9/2005 | Matsuoka | F25B 31/004 62/470 |
| 9,470,230 | B2 * | 10/2016 | Koyama | F25B 31/004 |
| 2011/0081254 | A1 * | 4/2011 | Hafkemeyer | F25B 31/002 417/13 |
| 2012/0023978 | A1 * | 2/2012 | Chae | F25B 5/02 62/115 |

FOREIGN PATENT DOCUMENTS

| | | | |
|---|---|---|---|
| CN | 204494911 | U | 7/2015 |
| CN | 205260257 | U | 5/2016 |
| CN | 107747544 | A | 3/2018 |
| CN | 207454278 | U | 6/2018 |
| JP | 2003130474 | A | 5/2003 |
| JP | 2005076515 | A | 3/2005 |
| JP | 2013238142 | A | 11/2013 |

* cited by examiner

COMPRESSOR WITH OIL EQUALIZING PIPE, PARALLEL COMPRESSOR SET, AND OIL EQUALIZING METHOD

FIELD OF THE INVENTION

The present disclosure relates to the technical field of compressors, and in particular, to a compressor with an oil equalizing pipe, a parallel compressor set, and an oil equalizing method.

BACKGROUND OF THE INVENTION

A compressor is a fluid machine that lifts a low-pressure gas into a high-pressure gas, and is the heart of a refrigeration system. The compressors connected in parallel in the refrigeration systems bring the advantages that it is convenient to adjust capacity, easy to maintain by single machine shutdown, low in cost and the like, and thus are widely used. Due to manufacturing differences of compressors, or different states of running or shutdown of different compressors, the distribution of oil output or oil return of the compressors is uneven, in this way, the oil masses of some compressors are increased and the oil masses of the other compressors are decreased after running, the compressors with too small oil masses may be damaged due to insufficient lubrication, so an oil balance design should be performed when the compressors are connected in parallel.

At present, the common practice for oil balance is to use an oil balance pipe to connect the oil sumps of two compressors. Although this method can play a role in oil balance to certain extent, it is easy to cause oil transfer between the two compressors due to the pressure difference between the compressors, resulting in imbalanced oil levels.

SUMMARY OF THE INVENTION

In order to overcome the above-mentioned shortcomings in the prior art, the objective of the present disclosure is to provide a compressor with an oil equalizing pipe, a parallel compressor set, and an oil equalizing method.

In order to achieve the above objective, the technical solution adopted by the present disclosure to solve its technical problem is as follows: a compressor with an oil equalizing pipe includes a compressor body, the compressor body is provided with a suction port and an exhaust port, an oil sump is disposed at the bottom of the compressor body, the compressor further includes at least one oil equalizing pipe, an opening at one end of the oil equalizing pipe is formed in a target oil level of the oil sump, and the opening at the other end of the oil equalizing pipe is formed in the suction port; and when the oil level of the oil sump of the compressor is higher than the target oil level, the extra oil enters the suction port through the oil equalizing pipe.

Compared with the prior art, the present disclosure has the advantages that, when the compressor is running, the gas in the suction port flows, so that the pressure at the suction port is less than the pressure on the surface of the oil sump, when the oil level of the oil sump of the compressor is higher than the target oil level, the extra oil enters the suction port through the oil equalizing pipe under the action of the above pressure difference, a part of the oil enters vortex and is discharged from the compressor via the exhaust port, and the oil discharged from the compressor returns to the other compressor lack of oil through a pipeline, thereby achieving the oil balance between different compressors.

Further, the oil equalizing pipe is disposed in a compressor body shell.

By adopting the above preferred solution, it is conducive to avoiding the risk that the oil equalizing pipe is damaged by the collision of foreign objects, and the joints between the oil equalizing pipe and other parts are all located in the compressor body shell, thereby avoiding the risk of oil leakage.

Further, the middle pipe body part of the oil equalizing pipe is disposed on an outer side of the compressor body shell.

By adopting the above preferred solution, it is conducive to saving the space in the compressor, and avoiding cost increase resulted from the size increase of the compressor, and the welding between the oil equalizing pipe and a suction pipe can be performed after the compressor is manufactured, so the operation is easy.

Further, the oil equalizing pipe is provided with a bent part at the end of the suction port, and the axis of the pipe body of the bent part is parallel to the airflow direction at the suction port.

By adopting the above preferred solution, the outlet direction of the oil equalizing pipe is along the suction airflow direction, so that the extra oil can be brought into the vortex by the negative pressure of the airflow more easily, so as to be discharged from the compressor via the exhaust port.

Further, an ultrasonic atomizer is disposed on the periphery of the pipe body of the oil equalizing pipe near the suction port.

By adopting the above preferred solution, the oil sucked out by the oil equalizing pipe can be atomized, thereby making it easier for the oil to enter the vortex to be discharged from the exhaust port.

A parallel compressor set includes at least two compressors with oil equalizing pipes as described above, the suction port of each compressor is connected with a main suction port through a suction branch pipeline, the exhaust port of each compressor is connected to an air inlet of an oil-gas separator through an exhaust branch pipeline, then an air outlet of each oil-gas separator is connected to a main exhaust port, and an oil outlet of each oil-gas separator is divided into a plurality of oil return circuits communicating with the suction branch pipelines respectively.

By adopting the above preferred solution, when the compressor is running, the gas in the suction port flows, so that the pressure at the suction port is less than the pressure on the surface of the oil sump, when the oil level of the oil sump of the compressor is higher than the target oil level, the extra oil enters the suction port through the oil equalizing pipe under the action of the above pressure difference, a part of the oil enters vortex and is discharged from the compressor via the exhaust port, a part of the oil discharged from the compressor returns to the other compressor lack of oil through the oil-gas separator, no oil is sucked from the oil sump into the suction port from the oil equalizing pipe of the compressor lack of oil, so that the oil discharged from the exhaust port of the compressor lack of oil is very little, that is, the oil mass discharged from the compressor with extra oil is greater than the oil mass discharged from the compressor lack of oil, and the oil balance between different compressors is realized after multiple circles; and the oil-gas separator is also provided with an oil return circuit that communicates with the suction branch pipeline of its corresponding compressor for ensuring the lubrication requirements of internal parts.

Further, a flowmeter is connected in series to the oil equalizing pipe of each compressor, and a proportional flow control valve is disposed on an oil return circuit at the oil outlet of each oil-gas separator, which communicates with the suction branch pipeline of the paired compressor; the parallel compressor set further includes a controller, which controls the output quantity of the corresponding proportional flow control valve according to the flow data of the flowmeter corresponding to each compressor.

By adopting the above preferred solution, the mass of return oil can be optimized and controlled according to the flow of the oil equalizing pipe, and the oil balance can be achieved more quickly.

Further, the output quantity of the proportional flow valve corresponding to the $k^{th}$ compressor satisfies the following relationship: when the flow $V_k$ of the oil equalizing pipe of the $k^{th}$ compressor is greater than an average value of the flow of all oil equalizing pipes, the output quantity $P_k$ of the proportional flow valve corresponding to the $k^{th}$ compressor is set as the minimum flow $V_{min}$ of the flow of all oil equalizing pipes; and when the flow $V_k$ of the oil equalizing pipe of the $k^{th}$ compressor is less than or equal to the average value of the flow of all oil equalizing pipes, the output quantity $P_k$ of the proportional flow valve corresponding to the $k^{th}$ compressor is set as the average value of the flow of all oil equalizing pipes.

By adopting the above preferred solution, the oil return ratio of each oil circuit is further optimized, so that the oil balance and the oil lubrication of the compressors achieve an optimal state.

An oil equalizing method, for balancing the lubricating oil in oil sumps of compressors connected in parallel, includes the following steps: step 1, disposing an oil equalizing pipe between the oil sump and a suction port of each compressor, wherein an opening at one end of the oil equalizing pipe is formed in a target oil level of the oil sump, and the opening at the other end of the oil equalizing pipe is formed in the suction port; and step 2, connecting the suction port of each compressor with a main suction port through a suction branch pipeline, respectively connecting the exhaust port of each compressor to an air inlet of an oil-gas separator through an exhaust branch pipeline, then connecting an air outlet of each oil-gas separator to a main exhaust port, and dividing an oil outlet of each oil-gas separator into a plurality of oil return circuits communicating with the suction branch pipelines respectively.

By adopting the above preferred solution, when the compressor is running, the gas in the suction port flows, so that the pressure at the suction port is less than the pressure on the surface of the oil sump; when the oil level of the oil sump of the compressor is higher than the target oil level, the extra oil enters the suction port through the oil equalizing pipe under the action of the above pressure difference, a part of the oil enters vortex and is discharged from the compressor via the exhaust port, a part of the oil discharged from the compressor returns to the other compressor lack of oil through the oil-gas separator, no oil is sucked from the oil sump into the suction port from the oil equalizing pipe of the compressor lack of oil, so that the oil discharged from the exhaust port of the compressor lack of oil is very little, that is, the oil mass discharged from the compressor with extra oil is greater than the oil mass discharged from the compressor lack of oil, and the oil balance between different compressors is realized after multiple circles; and the oil-gas separator is also provided with the oil return circuit that communicates with the suction branch pipeline of its corresponding compressor for ensuring the lubrication requirements of internal parts.

Further, the method further includes: step 3. connecting a flowmeter in series to the oil equalizing pipe of each compressor, and disposing a proportional flow control valve on an oil return circuit at the oil outlet of each oil-gas separator, which communicates with the suction branch pipeline of the paired compressor, wherein the output quantity of the proportional flow valve corresponding to the $k^{th}$ compressor satisfies the following relationship: when the flow $V_k$ of the oil equalizing pipe of the $k^{th}$ compressor is greater than an average value of the flow of all oil equalizing pipes, the output quantity $P_k$ of the proportional flow valve corresponding to the $k^{th}$ compressor is set as the minimum flow $V_{min}$ of the flow of all oil equalizing pipes; and when the flow $V_k$ of the oil equalizing pipe of the $k^{th}$ compressor is less than or equal to the average value of the flow of all oil equalizing pipes, the output quantity $P_k$ of the proportional flow valve corresponding to the $k^{th}$ compressor is set as the average value of the flow of all oil equalizing pipes.

By adopting the above preferred solution, the oil return ratio of each oil circuit is further optimized, so that the oil balance and the oil lubrication of the compressors achieve an optimal state.

BRIEF DESCRIPTION OF THE DRAWINGS

To illustrate technical solutions in the embodiments of the present disclosure or in the prior art more clearly, a brief introduction on the drawings which are needed in the description of the embodiments or the prior art is given below. Apparently, the drawings in the description below are merely some of the embodiments of the present disclosure, based on which other drawings can be obtained by those of ordinary skill in the art without any creative effort.

REFERENCE SIGNS

1*a*/1*b*—compressor; 10—compressor body; 11—suction port; 12—exhaust port; 13—oil sump; 14—oil equalizing pipe; 15—oil spray head; 16—spray head angle adjustment mechanism; 161—first connecting rod; 162—piston rod; 163—second connecting rod; 164—rotating wheel; 165—deceleation driving motor; 141—bent part; 2*a*/2*b*—suction branch pipeline; 20—main suction port; 3*a*/3*b*—exhaust branch pipeline; 30—main exhaust port; 4*a*/4*b*—oil-gas separator; 5*a*1/5*a*2/5*b*1/5*b*2—oil return circuit; 6*a*/6*b*—flowmeter; and 7*a*/7*b*—proportional flow control valve.

DETAILED DESCRIPTION OF THE EMBODIMENTS

A clear and complete description of technical solutions in the embodiments of the present disclosure will be given below, in combination with the drawings in the embodiments of the present disclosure. Apparently, the embodiments described below are merely a part, but not all, of the embodiments of the present disclosure. All of other embodiments, obtained by those of ordinary skill in the art based on the embodiments of the present disclosure without any creative effort, fall into the protection scope of the present disclosure.

Figure 1:
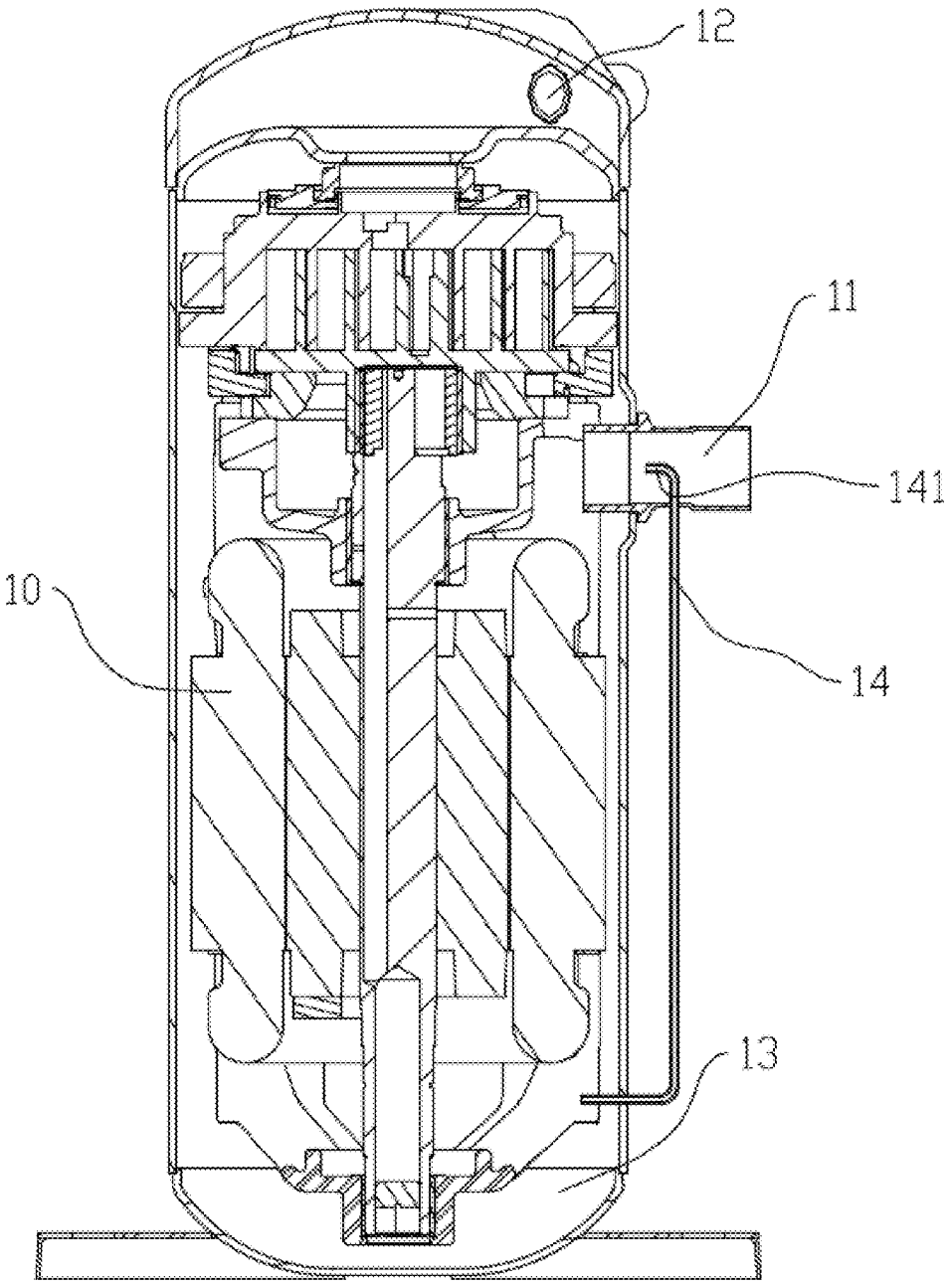
FIG. 1 is a schematic structural diagram of one embodiment of a compressor of the present disclosure.

As shown in FIG. 1, a compressor with an oil equalizing pipe includes a compressor body 10, the compressor body 10 is provided with a suction port 11 and an exhaust port 12, an oil sump 13 is disposed at the bottom of the compressor body 10, the compressor further includes at least one oil equalizing pipe 14, an opening at one end of the oil equalizing pipe 14 is formed in a target oil level of the oil sump 13, and the opening at the other end of the oil equalizing pipe is formed in the suction port 11; and when the oil level of the oil sump 13 of the compressor is higher than the target oil level, the extra oil enters the suction port 11 through the oil equalizing pipe 14.

The beneficial effects of adopting the above technical solution are that: when the compressor is running, the gas in the suction port 11 flows, so that the pressure at the suction port 11 is less than the pressure on the surface of the oil sump 13, when the oil level of the oil sump 13 of the compressor is higher than the target oil level, the extra oil enters the suction port 11 through the oil equalizing pipe 14 under the action of the above pressure difference, a part of the oil enters vortex and is discharged from the compressor via the exhaust port 12, and the oil discharged from the compressor returns to the other compressor lack of oil through a pipeline, thereby achieving the oil balance between different compressors.

Figure 2:
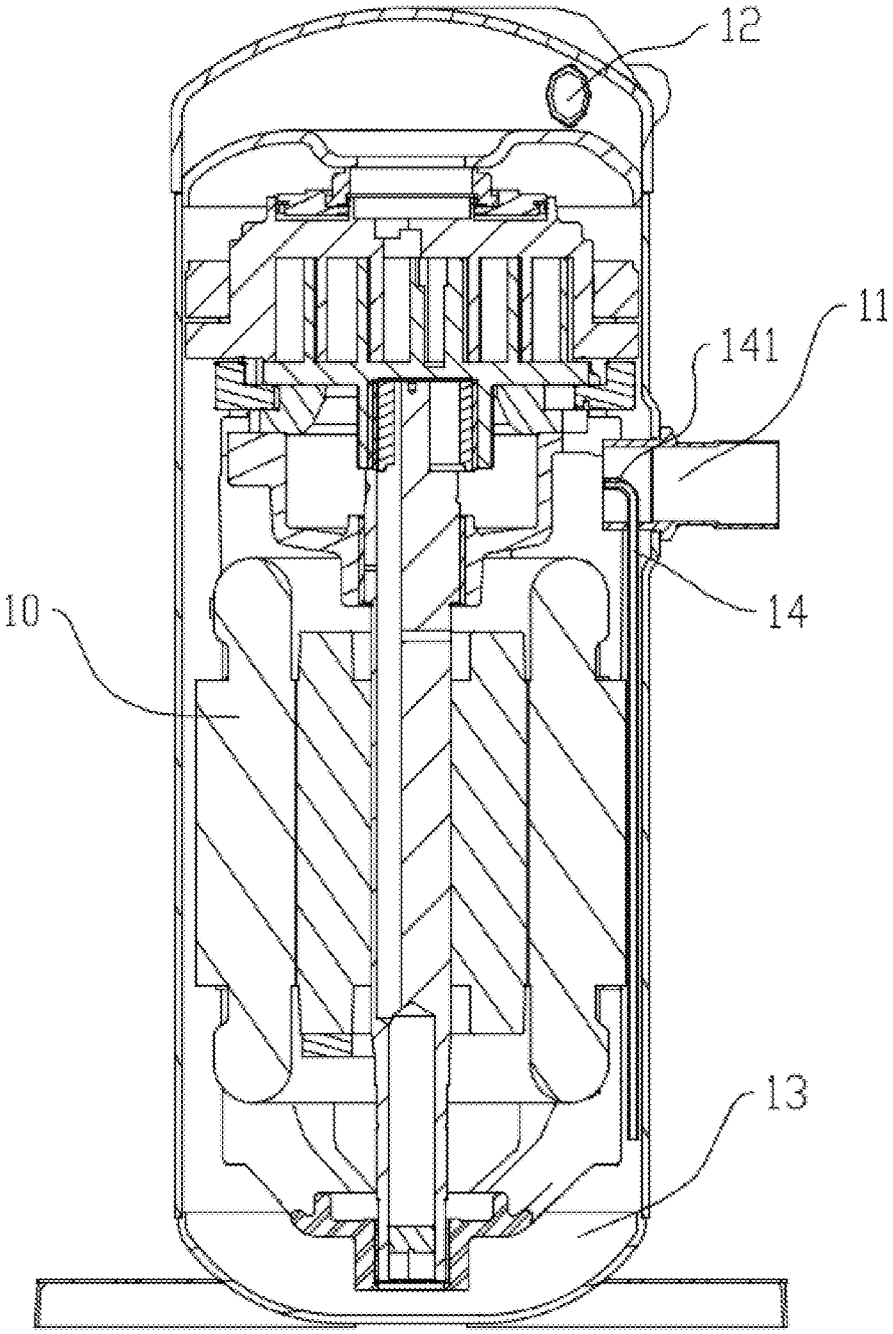
FIG. 2 is a schematic structural diagram of another embodiment of the compressor of the present disclosure.

As shown in FIG. 2, in some other embodiments of the present disclosure, the oil equalizing pipe 14 is disposed in a compressor body 10 shell. The beneficial effects of adopting the above technical solution are that: it is conducive to avoiding the risk that the oil equalizing pipe 14 is damaged by the collision of foreign objects, and the joints between the oil equalizing pipe 14 and other parts are located in the compressor body 10 shell, thereby avoiding the risk of oil leakage.

As shown in FIG. 1, in some other embodiments of the present disclosure, the middle pipe body part of the oil equalizing pipe 14 is disposed on an outer side of the compressor body 10 shell. The beneficial effects of adopting the above technical solution are that: it is conducive to saving the space in the compressor, and avoiding cost increase resulted from the size increase of the compressor, and the welding between the oil equalizing pipe and a suction pipe can be performed after the compressor is manufactured, so the operation is easy.

In some other embodiments of the present disclosure, the oil equalizing pipe 14 is provided with a bent part 141 at the end of the suction port 11, and the axis of the pipe body of the bent part 141 is parallel to the airflow direction at the suction port 11. The beneficial effects of adopting the above technical solution are that: the outlet direction of the oil equalizing pipe 14 is along the suction airflow direction, so that the extra oil can be brought into the vortex by the negative pressure of the airflow more easily, so as to be discharged from the compressor via the exhaust port.

In some other embodiments of the present disclosure, an ultrasonic atomizer is disposed on the periphery of the pipe body of the oil equalizing pipe near the suction port. The beneficial effects of adopting the above technical solution are that: the oil sucked out by the oil equalizing pipe can be atomized, thereby making it easier for the oil to enter the vortex to be discharged from the exhaust port.

Figure 5:
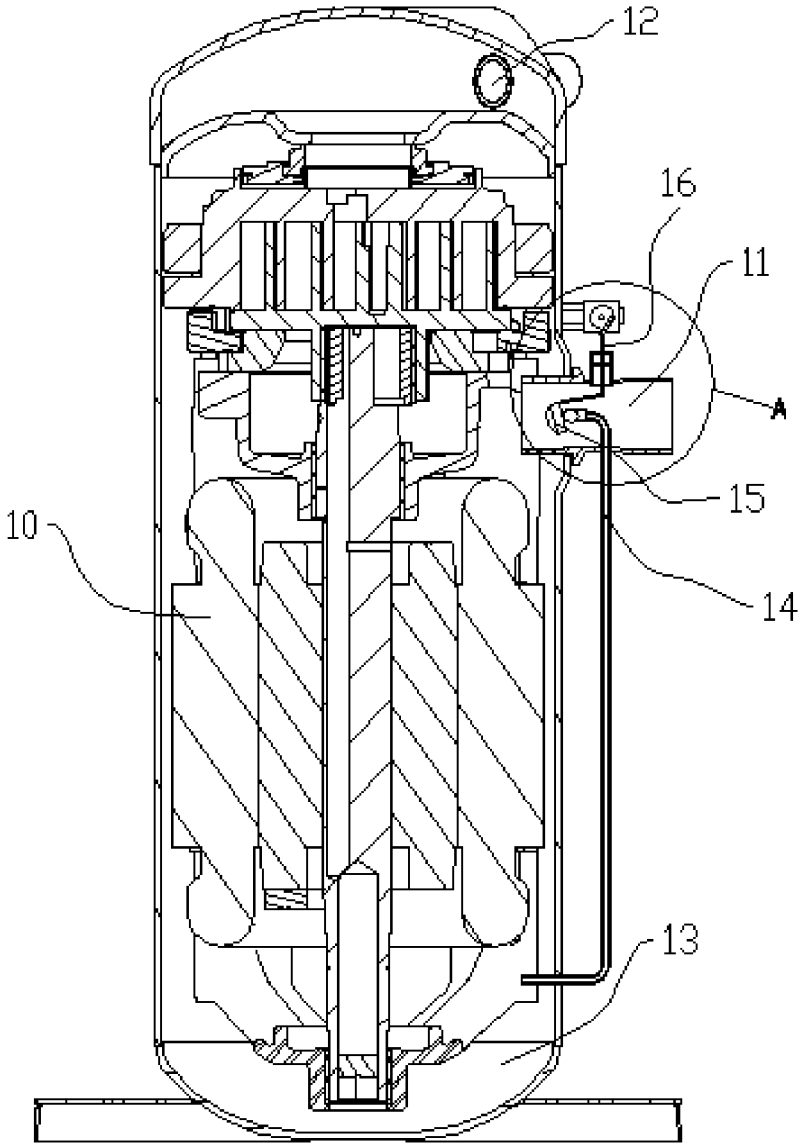
FIG. 5 is a schematic structural diagram of another embodiment of the compressor of the present disclosure.
Figure 6:
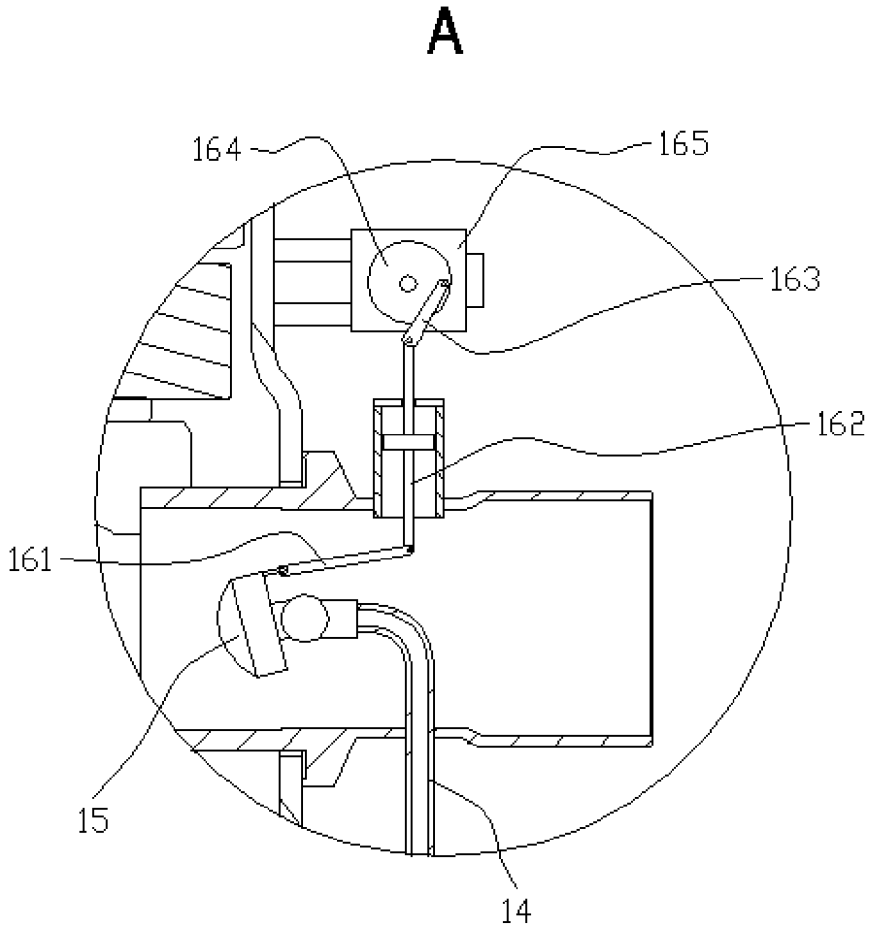
FIG. 6 is a partially enlarged drawing of part A in FIG. 5.

As shown in FIG. 5 to FIG. 6, in some other embodiments of the present disclosure, a rotatable oil spray head 15 is installed at the oil outlet of the oil equalizing pipe 14. A torsional spring is installed at the rotary hinge site of the oil spray head 15, and as shown in FIG. 6, the torsional spring causes the oil spray head 15 to have the potential energy of rotating counterclockwise around the hinge point. The upper end of the oil spray head 15 is also hinged with a spray head angle adjustment mechanism 16. The spray head angle adjustment mechanism 16 can adjust the direction of the oil spray head 15 facing the inner cavity of the compressor, so as to change the amount of oil distributed to an armature part and a vortex swirl sheet part of the compressor. In FIG. 6, the more the oil spray head 15 faces to the lower left direction, the more the oil will enter the armature part of the compressor, that is, more oil is used for lubricating the armature part and finally drops into the oil sump 13 at the lower part of the present compressor; and the more the oil spray head 15 faces to the top left direction, the more the oil will enter the vortex swirl sheet part of the compressor, that is, more oil is discharged to all compressors of the compressor set from an exhaust pipe along the refrigerant to be reallocated. The spray head angle adjustment mechanism 16 includes a first connecting rod 161 hinged with the upper part of the oil spray head 15, a piston rod 162 hinged with one end of the first connecting rod 161, a second connecting rod 163 hinged with the upper end of the piston rod 162, and a deceleration driving motor 165, and the second connecting rod 163 is hinged at a non-circular position of a rotating wheel 164 of the deceleration driving motor 165. The deceleration driving motor 165 drives the rotating wheel 164 to rotate to cause the piston rod 162 to reciprocate up and down via the transmission of the second connecting rod 163, and finally, the oil spray head 15 is driven to swing by a small angle around its hinge point via the transmission of the first connecting rod 161 to change the oil spray angle. The deceleration driving motor 165 is used to facilitate the automatic control operation, and it can also be replaced by a manual handle, and the rotating wheel 164 is manually rotated and is stopped by a bayonet lock to achieve manual adjustment.

Figure 3:
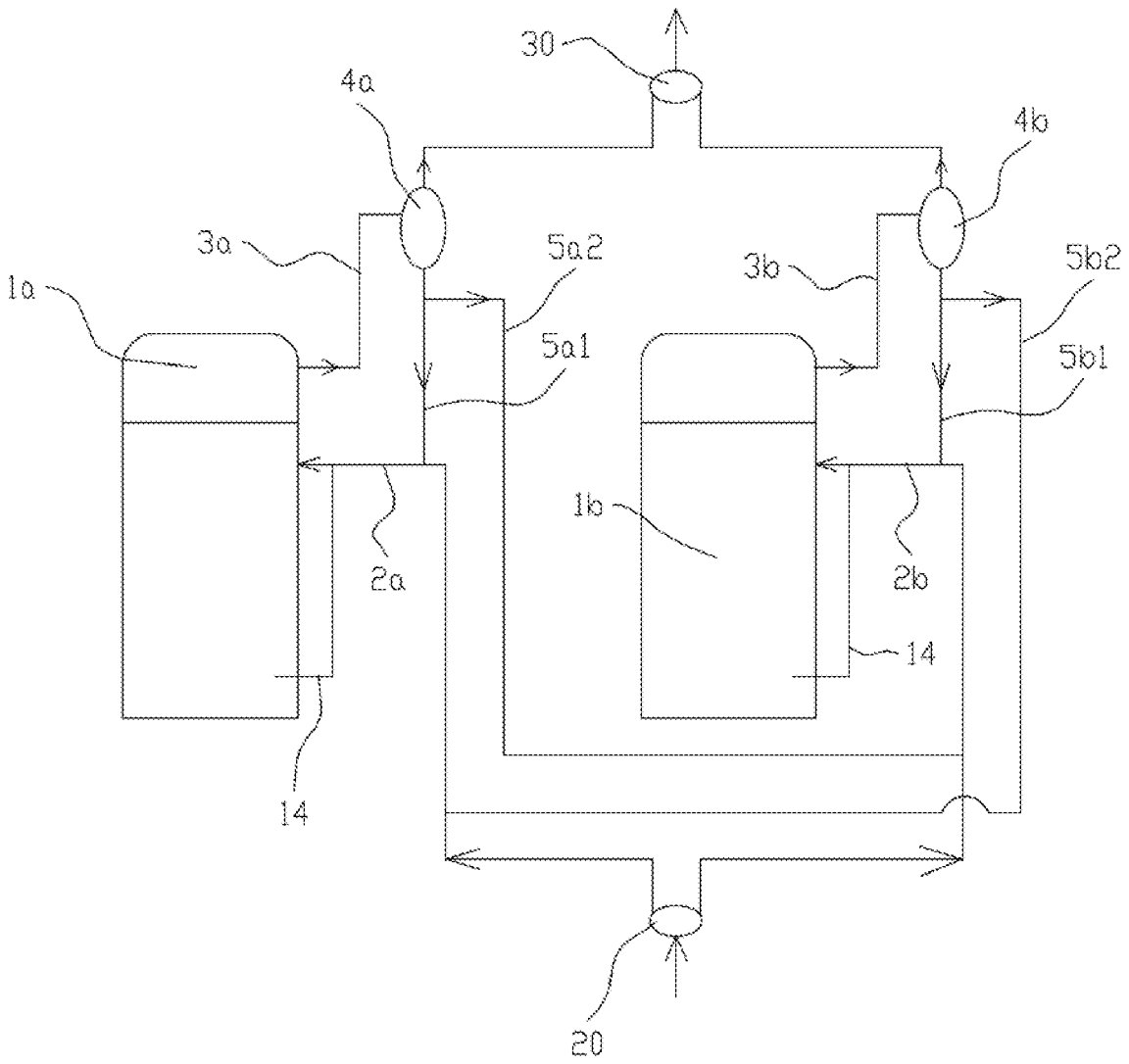
FIG. 3 is a schematic structural diagram of one embodiment of a compressor set of the present disclosure.

As shown in FIG. 3, a parallel compressor set includes at least two compressors 1*a*/1*b* with oil equalizing pipes as described above, the suction port of each compressor 1*a*/1*b* is connected with a main suction port 20 through a suction branch pipeline 2*a*/2*b*, the exhaust port of each compressor 1*a*/1*b* is connected to an air inlet of an oil-gas separator 4*a*/4*b* through an exhaust branch pipeline 3*a*/3*b*, then an air outlet of each oil-gas separator 4*a*/4*b* is connected to a main exhaust port 30, an oil outlet of the oil-gas separator 4*a* is divided into oil return circuits 5*a*1, 5*a*2 communicating with the suction branch pipelines 2*a*, 2*b* respectively, and the oil outlet of the oil-gas separator 4*b* is divided into oil return circuits 5*b*1, 5*b*2 communicating with the suction branch pipelines 2*b*, 2*a* respectively.

The beneficial effects of adopting the above technical solution are that: when the compressors 1*a*/1*b* are running, the gas in the suction port flows, so that the pressure at the suction port 11 is less than the pressure on the surface of the oil sump 13, when the oil level of the oil sump 13 of the compressor 1*a* is higher than the target oil level, the extra oil enters the suction port 11 through the oil equalizing pipe 14 under the action of the above pressure difference, a part of the oil enters vortex and is discharged from the compressor 1*a* via the exhaust port 12, and the oil discharged from the compressor 1*a* returns to the other compressor 1*b* lack of oil through the oil-gas separator 4*a*, no oil is sucked from the oil sump 13 into the suction port 11 from the oil equalizing pipe 14 of the compressor 1*b* lack of oil, so that the oil discharged from the exhaust port 12 of the compressor 1*b* lack of oil is very little, that is, the oil mass discharged from the compressor 1*a* with extra oil is greater than the oil mass discharged from the compressor 1*b* lack of oil, and the oil balance between the compressors 1*a*/1*b* is realized after multiple circles; and the oil-gas separator 4*a* is also provided with the oil return circuit 5*a*1 that communicates with the suction branch pipeline 2*a* of its corresponding compressor 1*a* for ensuring the lubrication requirements of internal parts.

Figure 4:
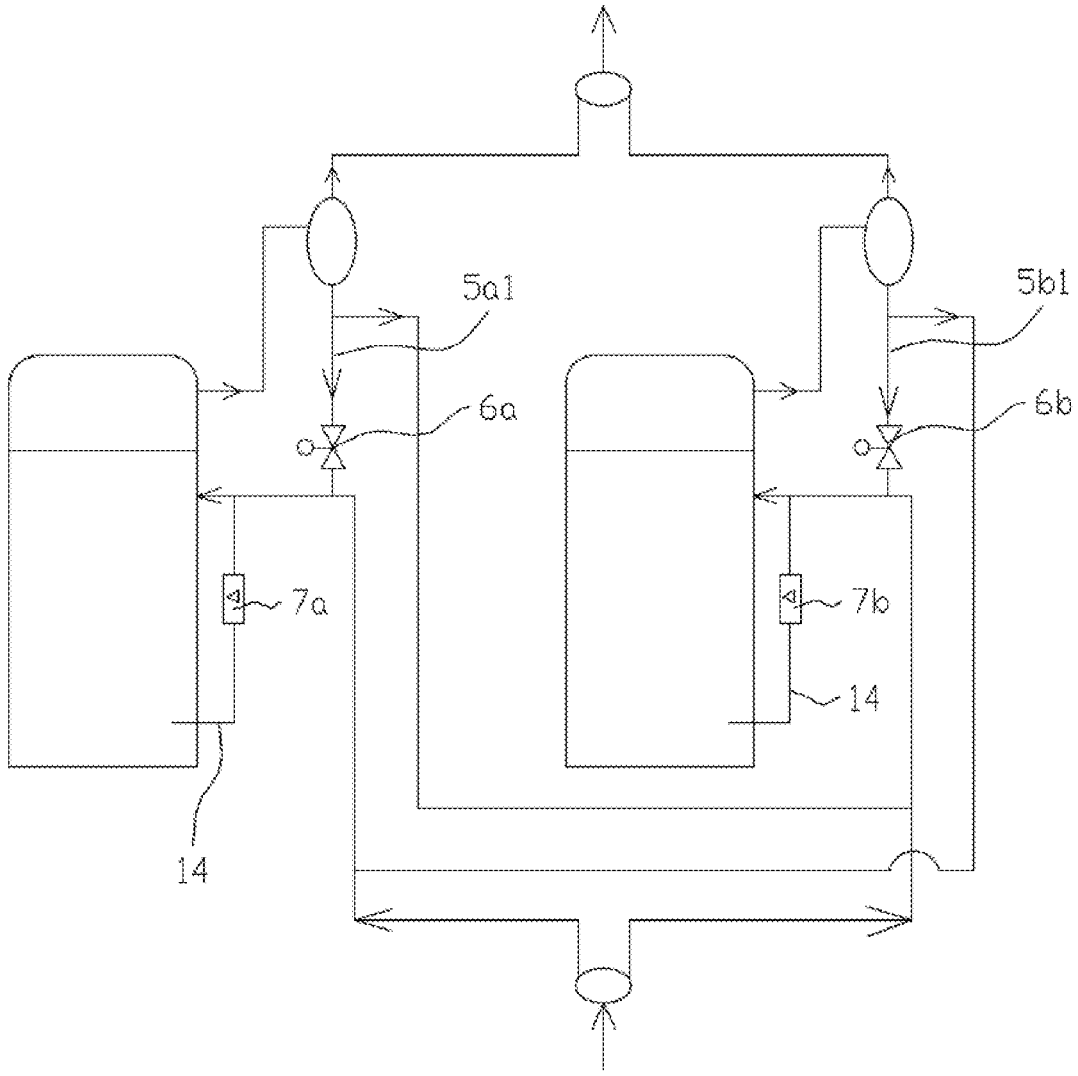
FIG. 4 is a schematic structural diagram of another embodiment of the compressor set of the present disclosure.

As shown in FIG. 4, in some other embodiments of the present disclosure, a flowmeter 7*a*/7*b* is connected in series to the oil equalizing pipe 14 of each compressor 1*a*/1*b*, and a proportional flow control valve 6*a*/6*b* is disposed on the oil return circuit 5*a*1/5*b*1 at the oil outlet of each oil-gas separator 4*a*/4*b*, which communicates with the suction branch pipeline of the paired compressor. The parallel compressor set further includes a controller, which controls the output quantity of the corresponding proportional flow control valve 6*a*/6*b* according to the flow data of the flowmeter 7*a*/7*b* corresponding to each compressor 1*a*/1*b*. The beneficial effects of adopting the above technical solution are that: the oil mass of return oil can be optimized and controlled according to the flow of the oil equalizing pipe, and the oil balance can be achieved more quickly.

In some other embodiments of the present disclosure, the output quantity of the proportional flow valve corresponding to the $k^{th}$ compressor satisfies the following relationship: when the flow $V_k$ of the oil equalizing pipe of the $k^{th}$ compressor is greater than an average value of the flow of all oil equalizing pipes, the output quantity $P_k$ of the proportional flow valve corresponding to the $k^{th}$ compressor is set as the minimum flow $V_{min}$ of the flow of all oil equalizing pipes; and when the flow $V_k$ of the oil equalizing pipe of the $k^{th}$ compressor is less than or equal to the average value of the flow of all oil equalizing pipes, the output quantity $P_k$ of the proportional flow valve corresponding to the $k^{th}$ compressor is set as the average value of the flow of all oil equalizing pipes. The beneficial effects of adopting the above technical solution are that: the oil return ratio of the oil circuits is further optimized, so that the oil balance and the oil lubrication of the compressors achieve an optimal state An oil equalizing method, for balancing the lubricating oil in oil sumps of compressors connected in parallel, includes the following steps: step 1, disposing an oil equalizing pipe between the oil sump and a suction port of each compressor, wherein an opening at one end of the oil equalizing pipe is formed in a target oil level of the oil sump, and the opening at the other end of the oil equalizing pipe is formed in the suction port; and step 2, connecting the suction port of each compressor with a main suction port through a suction branch pipeline, respectively connecting the exhaust port of each compressor to an air inlet of an oil-gas separator through an exhaust branch pipeline, then connecting an air outlet of each oil-gas separator to a main exhaust port, and dividing an oil outlet of each oil-gas separator into a plurality of oil return circuits communicating with the suction branch pipelines respectively.

The beneficial effects of adopting the above technical solution are that: when the compressor is running, the gas in the suction port flows, so that the pressure at the suction port is less than the pressure on the surface of the oil sump, when the oil level of the oil sump of the compressor is higher than the target oil level, the extra oil enters the suction port through the oil equalizing pipe under the action of the above pressure difference, a part of the oil enters vortex and is discharged from the compressor via the exhaust port, a part of the oil discharged from the compressor returns to the other compressor lack of oil through the oil-gas separator, no oil is sucked from the oil sump into the suction port from the oil equalizing pipe of the compressor lack of oil, so that the oil discharged from the exhaust port of the compressor lack of oil is very little, that is, the oil mass discharged from the compressor with extra oil is greater than the oil mass discharged from the compressor lack of oil, and the oil balance between different compressors is realized after multiple circles; and the oil-gas separator is also provided with the oil return circuit that communicates with the suction branch pipeline of its corresponding compressor for ensuring the lubrication requirements of internal parts. The beneficial effects of adopting the above technical solution are that: the oil return ratio of the oil circuits is further optimized, so that the oil balance and the oil lubrication of the compressors achieve an optimal state.

The above embodiments are only used for explaining the technical concepts and features of the present disclosure, and the purpose thereof is to enable those of ordinary skill in the art to understand and implement the contents of the present disclosure, but the protection scope of the present disclosure is not limited thereto, and equivalent variations or modifications made according to the spirit essence of the present disclosure shall fall within the protection scope of the present disclosure.

The invention claimed is:

1. A parallel compressor set, comprising at least two compressors with an oil equalizing pipe, wherein the each compressor with an oil equalizing pipe comprises a compressor body, the compressor body being provided with a suction port and an exhaust port, an oil sump being disposed at the bottom of the compressor body, wherein the compressor further comprises at least one oil equalizing pipe, an opening at one end of the oil equalizing pipe is formed in a target oil level of the oil sump, and an opening at an other end of the oil equalizing pipe is formed in the suction port; and when an oil level of the oil sump of the compressor is higher than the target oil level, extra oil enters the suction port through the oil equalizing pipe, wherein the suction port of the each compressor is connected with a main suction port through a suction branch pipeline, the exhaust port of the each compressor is connected to an air inlet of an oil-gas separator through an exhaust branch pipeline, then an air outlet of each oil-gas separator is connected to a main exhaust port, and an oil outlet of each oil-gas separator is divided into a plurality of oil return circuits communicating with the suction branch pipelines respectively, wherein a flowmeter is connected in series to the oil equalizing pipe of the each compressor, and a proportional flow control valve is disposed on an oil return circuit at the oil outlet of the each oil-gas separator, which communicates with the suction branch pipeline of the paired compressor; the parallel compressor set further comprises a controller, which controls an output quantity of the corresponding proportional flow control valve according to flow data of the flowmeter corresponding to the each compressor, wherein the output quantity of the proportional flow valve corresponding to the each compressor satisfies the following relationship: when a flow $V_k$ of the oil equalizing pipe of the respective compressor is greater than an average value of a flow of all oil equalizing pipes, an output quantity $P_k$ of the proportional flow valve corresponding to the respective compressor is set as a minimum flow $V_{min}$ of the flow of all oil equalizing pipes; and when the flow $V_k$ of the oil equalizing pipe of the respective compressor is less than or equal to an average value of the flow of all oil equalizing pipes, the output quantity $P_k$ of the proportional flow valve corresponding to the respective compressor is set as the average value of the flow of all oil equalizing pipes.

2. The parallel compressor set according to claim 1, wherein the oil equalizing pipe is provided with a bent part at an end of the suction port, and an axis of the pipe body of the bent part is parallel to an airflow direction at the suction port.

3. The parallel compressor set according to claim 1, wherein an ultrasonic atomizer is disposed on a periphery of the pipe body of the oil equalizing pipe near the suction port.

4. An oil equalizing method, for balancing a lubricating oil in oil sumps of compressors connected in parallel, comprising the following steps:

step 1, disposing an oil equalizing pipe between the respective oil sump and a suction port of the each compressor, wherein an opening at one end of the oil equalizing pipe is formed in a target oil level of the oil sump, and an opening at an other end of the oil equalizing pipe is formed in the suction port;

step 2, connecting the suction port of the each compressor with a main suction port through a suction branch pipeline, respectively connecting an exhaust port of the each compressor to an air inlet of an oil-gas separator through an exhaust branch pipeline, then connecting an air outlet of each oil-gas separator to a main exhaust port, and dividing an oil outlet of each oil-gas separator into a plurality of oil return circuits communicating with the suction branch pipelines respectively; and step 3, connecting a flowmeter in series to the oil equalizing pipe of the each compressor, and disposing a proportional flow control valve on an oil return circuit at the oil outlet of each oil-gas separator, which communicates with the suction branch pipeline of the paired compressor, wherein an output quantity of the proportional flow valve corresponding to the respective compressor satisfies the following relationship: when a flow $V_k$ of the oil equalizing pipe of the respective compressor is greater than an average value of a flow of all oil equalizing pipes, an output quantity $P_k$ of the proportional flow valve corresponding to the respective compressor is set as a minimum flow $V_{min}$ of the flow of all oil equalizing pipes; and when the flow $V_k$ of the oil equalizing pipe of the respective compressor is less than or equal to the average value of the flow of all oil equalizing pipes, the output quantity $P_k$ of the proportional flow valve corresponding to the respective compressor is set as the average value of the flow of all oil equalizing pipes.

5. A parallel compressor set, comprising at least two compressors with oil equalizing pipes, wherein the each compressor with an oil equalizing pipe comprises a compressor body, the compressor body being provided with a suction port and an exhaust port, an oil sump being disposed at a bottom of the compressor body, wherein the compressor further comprises at least one oil equalizing pipe, an opening at one end of the oil equalizing pipe is formed in a target oil level of the oil sump, and an opening at an other end of the oil equalizing pipe is formed in the suction port; and when an oil level of the oil sump of the compressor is higher than the target oil level, extra oil enters the suction port through the oil equalizing pipe, wherein the oil equalizing pipe is disposed in a compressor body shell, wherein the suction port of each compressor is connected with a main suction port through a suction branch pipeline, the exhaust port of each compressor is connected to an air inlet of an oil-gas separator through an exhaust branch pipeline, then an air outlet of each oil-gas separator is connected to a main exhaust port, and an oil outlet of each oil-gas separator is divided into a plurality of oil return circuits communicating with the suction branch pipelines respectively, wherein a flowmeter is connected in series to the oil equalizing pipe of each compressor, and a proportional flow control valve is disposed on an oil return circuit at the oil outlet of each oil-gas separator, which communicates with the suction branch pipeline of the paired compressor; the parallel compressor set further comprises a controller, which controls an output quantity of the corresponding proportional flow control valve according to flow data of the flowmeter corresponding to each compressor, wherein an output quantity of the proportional flow valve corresponding to the each compressor satisfies the following relationship: when a flow $V_k$ of the oil equalizing pipe of the respective compressor is greater than an average value of a flow of all oil equalizing pipes, an output quantity $P_k$ of the proportional flow valve corresponding to the respective compressor is set as a minimum flow $V_{min}$ of the flow of all oil equalizing pipes; and when the flow $V_k$ of the oil equalizing pipe of the respective compressor is less than or equal to the average value of the flow of all oil equalizing pipes, the output quantity $P_k$ of the proportional flow valve corresponding to the respective compressor is set as the average value of the flow of all oil equalizing pipes.

6. The parallel compressor set according to claim 5, wherein the oil equalizing pipe is provided with a bent part at an end of the suction port, and an axis of the pipe body of the bent part is parallel to an airflow direction at the suction port.

7. The parallel compressor set according to claim 5, wherein an ultrasonic atomizer is disposed on a periphery of the pipe body of the oil equalizing pipe near the suction port.

8. A parallel compressor set, comprising at least two compressors with oil equalizing pipes, wherein the each compressor with an oil equalizing pipe comprises a compressor body, the compressor body being provided with a suction port and an exhaust port, an oil sump being disposed at a bottom of the compressor body, wherein the compressor further comprises at least one oil equalizing pipe, an opening at one end of the oil equalizing pipe is formed in a target oil level of the oil sump, and an opening at an other end of the oil equalizing pipe is formed in the suction port; and when an oil level of the oil sump of the compressor is higher than the target oil level, extra oil enters the suction port through the oil equalizing pipe, wherein a middle pipe body part of the oil equalizing pipe is disposed on an outer side of the compressor body shell, wherein the suction port of each compressor is connected with a main suction port through a suction branch pipeline, the exhaust port of each compressor is connected to an air inlet of an oil-gas separator through an exhaust branch pipeline, then an air outlet of each oil-gas separator is connected to a main exhaust port, and an oil outlet of each oil-gas separator is divided into a plurality of oil return circuits communicating with the suction branch pipelines respectively, wherein a flowmeter is connected in series to the oil equalizing pipe of each compressor, and a proportional flow control valve is disposed on an oil return circuit at the oil outlet of each oil-gas separator, which communicates with the suction branch pipeline of the paired compressor; the parallel compressor set further comprises a controller, which controls an output quantity of the corresponding proportional flow control valve according to flow data of the flowmeter corresponding to each compressor, wherein the output quantity of the proportional flow valve corresponding to the respective compressor satisfies the following relationship: when a flow $V_k$ of the oil equalizing pipe of the respective compressor is greater than an average value of a flow of all oil equalizing pipes, the output quantity $P_k$ of the proportional flow valve corresponding to the respective compressor is set as a minimum flow $V_{min}$ of the flow of all oil equalizing pipes; and when the flow $V_k$ of the oil equalizing pipe of the respective compressor is less than or equal to the average value of the flow of all oil equalizing pipes, the output quantity $P_k$ of the proportional flow valve corresponding to the respective compressor is set as the average value of the flow of all oil equalizing pipes.

9. The parallel compressor set according to claim 8, wherein the oil equalizing pipe is provided with a bent part at an end of the suction port, and an axis of the pipe body of the bent part is parallel to an airflow direction at the suction port.

10. The parallel compressor set according to claim 8, wherein an ultrasonic atomizer is disposed on a periphery of the pipe body of the oil equalizing pipe near the suction port.

* * * * *